US006342831B1

(12) United States Patent
Azima

(10) Patent No.: US 6,342,831 B1
(45) Date of Patent: Jan. 29, 2002

(54) ELECTRONIC APPARATUS

(75) Inventor: Henry Azima, Cambridge (GB)

(73) Assignee: New Transducers Limited, London (GB)

( * ) Notice: Subject to any disclaimer, the term of this patent is extended or adjusted under 35 U.S.C. 154(b) by 0 days.

(21) Appl. No.: 09/519,588

(22) Filed: Mar. 6, 2000

(30) Foreign Application Priority Data

Mar. 5, 1999 (GB) ..... 9905038

(51) Int. Cl.[7] ..... G08B 3/00

(52) U.S. Cl. ..... 340/384.1; 340/384.5; 340/384.73

(58) Field of Search ..... 340/384.1, 384.5, 340/384.73, 679, 691.1, 691.2, 692

(56) References Cited

U.S. PATENT DOCUMENTS

| | | | | |
|---|---|---|---|---|
| 3,247,925 A | | 4/1966 | Warnaka | 181/31 |
| 4,554,419 A | * | 11/1985 | King et al. | 200/5 A |
| 5,091,713 A | | 2/1992 | Horne et al. | 340/541 |
| 5,408,417 A | | 4/1995 | Wilder | 364/479 |
| 5,445,295 A | | 8/1995 | Brown | 221/3 |
| 5,482,139 A | | 1/1996 | Rivalto | 186/36 |

FOREIGN PATENT DOCUMENTS

| | | |
|---|---|---|
| GB | 2 289 360 | 11/1995 |
| WO | WO 92/03024 | 2/1992 |
| WO | WO 97/09698 | 3/1997 |
| WO | WO 97/09842 | 3/1997 |

* cited by examiner

*Primary Examiner*—Daryl Pope
(74) *Attorney, Agent, or Firm*—Foley & Lardner

(57) ABSTRACT

Electronic apparatus incorporating a loudspeaker, wherein the loudspeaker comprises a bending wave panel member having a user-accessible surface, an electro-acoustic vibration exciter on the panel member to introduce bending wave energy into the panel member in response to an electrical signal applied thereto, and at least one touch sensitive area on or associated with the said user-accessible surface and responsive to user contact.

8 Claims, 1 Drawing Sheet

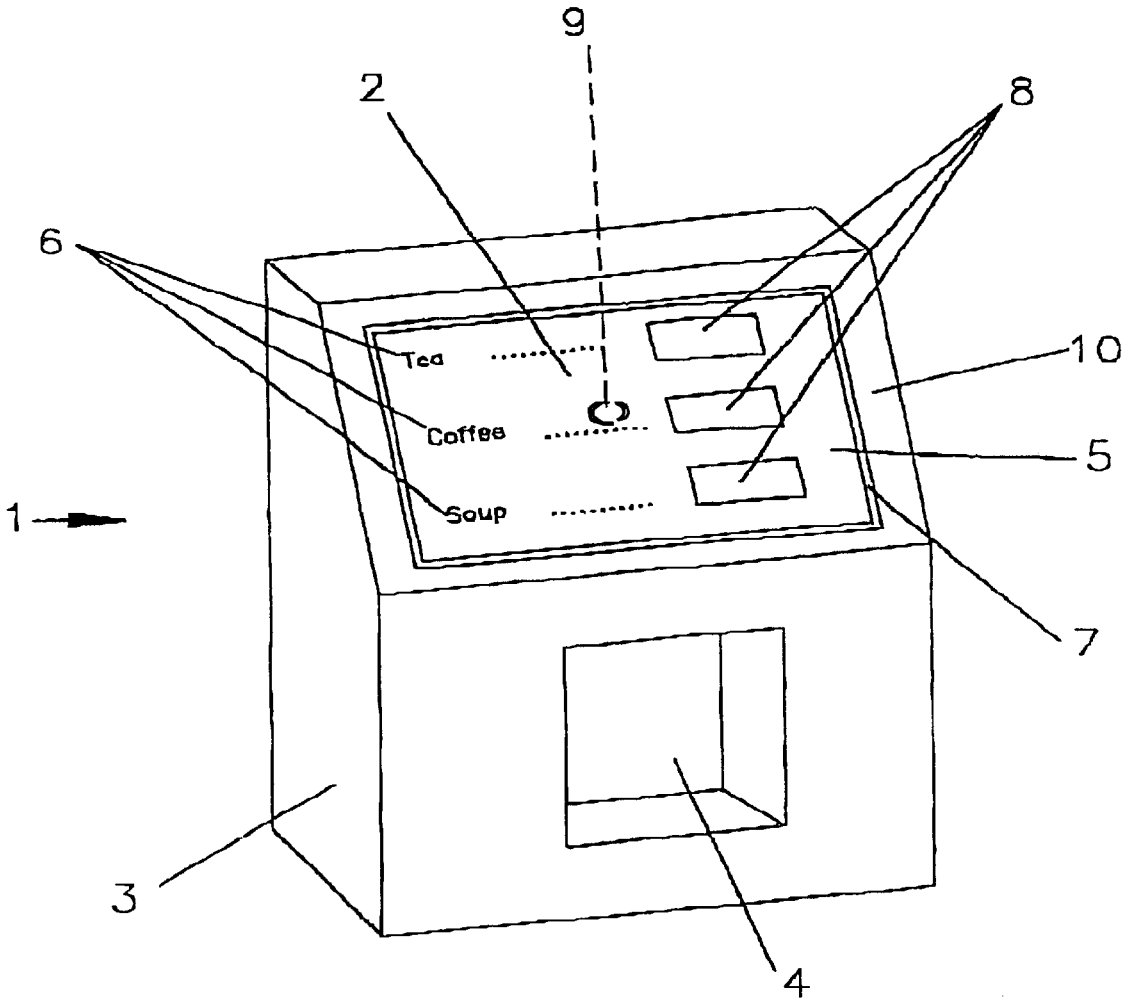
9
2
8
6
Tea
10
Coffee
5
1
Soup
7
3
4

ELECTRONIC APPARATUS

TECHNICAL FIELD

The invention relates to electronic or electrical apparatus (hereinafter 'electronic apparatus' in the following description and claims) incorporating a loudspeaker, more particularly a bending wave panel loudspeaker, e.g. of the kind described in WO97/09842.

BACKGROUND ART

Loudspeakers as described in WO97/09842 and its U.S. counterpart application Ser. No. 08/707,012, filed Sep. 3, 1996 (the latter being incorporated herein by reference in its entirety) are known as distributed mode, or DM, loudspeakers, and it is also known from these disclosures to teach the incorporation of bending wave panel loudspeakers in electronic apparatus such as portable compact-disc players, laptop computers, musical instruments and vending machines, etc.

SUMMARY OF THE INVENTION

It is an object of the invention to enhance the functionality of electronic apparatus incorporating a bending wave loudspeaker to enable direct user input, e.g. to control or operate the electronic apparatus. Such apparatus may be of widely different kinds, e.g. cellular telephones, vending machines, domestic appliances, etc.

According to the invention, there is provided electronic apparatus incorporating a loudspeaker, wherein the loudspeaker comprises a bending wave panel member having a user-accessible surface, a vibration exciter on the panel member to introduce bending wave energy into the panel member in response to an electrical signal applied thereto, and at least one touch sensitive area on or associated with the user-accessible surface and responsive to user contact. Thus the user responsive area may act as a touch controller, e.g., whereby the user can enter instructions or provide information or otherwise control the use of the electronic equipment.

Preferably the panel member has the capability to sustain and propagate input vibrational energy by a plurality of resonant bending wave modes in at least one operative area extending transversely of thickness, wherein the frequencies of resonant bending wave modes are interleaved in a predetermined frequency range so that resonant bending wave modes are substantially evenly distributed in frequency and wherein the vibration exciter is mounted on the operative area of the panel member, at a preferential location or site for coupling to the resonant bending wave modes, to vibrate the panel member and excite the resonant bending wave modes in the panel member, the resonant bending wave modes in turn producing an acoustic output.

Thus, for example, the loudspeaker may form a control panel, e.g. for operating a vending machine of the kind described in WO97/09842 and U.S. application Ser. No. 08/707,012. The invention is thus applicable to any electronic apparatus incorporating a bending wave speaker panel where a person is able to touch a portion of the panel surface, and may comprise pads or areas or switches or buttons which provide a means for instructions or other information to be entered to the electronic apparatus. Pressure switches may also be attached to the panel surface or embedded within the bending wave panel.

The speaker panel may incorporate other methods for presence sensing, including matrices of photodiodes and/or photocells round the perimeter of the panel and which sense the position, e.g. of a finger directed at a point on the panel. Where metallised contacts are used these may be of the metal oxide film or thin metal film type.

Applications include touch screen control for translucent display and lighting bending wave panel speakers, and for automated ticket machine (ATM) and vending machine applications. Many other categories are indicated, for example in consumer electronics such as a speaking or sound informing touch panel for a remote control unit, whether illuminated or not. The inventive concept may be applied to a mobile telephone display of suitable area, e.g. to combine a display, a loudspeaker and a control panel with illumination.

User feedback of control settings via the speaker panel with incorporated switch buttons would find utility in the control sections of hi-fi and audio equipment, particularly where complex setting up is required, for example in home theatre systems. Also domestic appliances, e.g. dishwashers, and clothes washing machines would benefit from the addition of this technology, as would industrial instrumentation, display orientated instructions such as analysers and oscilloscopes. The invention could be applied to laptop and other computer controls, points of sales data systems, personal, stock control and labelling devices, and also to automotive navigation units, automotive dashboard displays with a bending wave panel speaker, point of sale products with sound output and facility for user/customer data entry or control of operational information, and similarly for educational display units for museums, zoos, etc., including interactive audio visual devices.

BRIEF DESCRIPTION OF THE DRAWING

An example which embodies the best mode for carrying out the invention is described in detail below and is diagrammatically illustrated in the accompanying drawing, which is a perspective view showing a vending machine incorporating a bending wave panel loudspeaker/touch pad.

DETAILED DESCRIPTION

In the drawing there is shown a vending machine or ATM (1) comprising a generally rectangular cabinet (3) having an inclined front face (10) carrying a control panel (2) and a delivery chute (4) for dispensed articles below the control panel (2).

The control panel (2) is in the form of a generally rectangular resonant bending wave panel speaker (5) of the general kind described in WO97/09842 and U.S. application Ser. No. 08/707,012 and which is excited by a vibration exciter (9) mounted on the inner face of the panel speaker (5) so as not to be visible externally. The speaker panel is supported in a suspension (7), which could be resilient or clamped, supported in the front face (10) of the cabinet.

The visible face of the control panel/speaker is printed with information (6) as to the nature of the articles or products to be dispensed and the information has associated therewith touch sensitive panels (8) so that a purchaser can input an instruction by manual contact with the panels (8) in a manner known per se. The instructions can be confirmed and/or information can be reinforced by an audio output from the machine (1) delivered by the speaker (5). It will be appreciated that the machine will require associated electronic equipment to replay stored audio messages and to receive input information from the touch pads, but such electronic equipment is generally conventional.

This unique combination is possible because in contrast to the fragile cone of a conventional speaker, which may be easily damaged by finger contact, and would not sustain the finger pressures of reliable touch pad actuation, a bending panel speaker is tough, indeed may be made of vandal proof materials and is relatively unaffected by finger contact. Thus the panel which forms the interface to the user/customer is an integration of speaker and user data entry at the point of input and the speaker can provide verbal reply to the data entered in addition to leading the user through the usual questions associated with a sale.

The touch pads may have a surface embossing or similar raised indicia so that persons of impaired sight may use the keyboard represented by the touch pads and be helped by the relevant audio feedback from the speaker/touch pad device.

Evidently other applications for the device may be found for the control panels of many appliances such as washing machines, toasters, etc. room thermostats, sound and light controllers, and burglar alarm control panels. Also automotive controls panels would benefit where the speaker device may also be an integral part of trim or constructional parts such as the dashboard.

The touch sensing may be capacitative or pressure sensitive via thin laminated films, or be micro reflex switches, or be paired and/or interdigitated conductive regions.

The invention thus provides a resonant panel loudspeaker of increased functionality.

What is claimed is:

1. Electronic apparatus incorporating a loudspeaker, wherein the loudspeaker comprises a bending wave panel member having a user-accessible surface, an electro-acoustic vibration exciter on the panel member to introduce bending wave energy into the panel member in response to an electrical signal applied thereto, and at least one touch sensitive area on the said user-accessible surface and responsive to user contact.

2. Apparatus according to claim 1, wherein the panel member has the capability to sustain and propagate input vibrational energy by a plurality of resonant bending wave modes in at least one operative area extending transversely of thickness, wherein the frequencies of resonant bending wave modes are interleaved in a predetermined frequency range so that resonant bending wave modes are substantially evenly distributed in frequency and wherein the vibration exciter is mounted on said operative area of the panel member, at a preferential location or site for coupling to the resonant bending wave modes, to vibrate the panel member and excite said resonant bending wave modes in the panel member, the resonant bending wave modes in turn producing an acoustic output.

3. Apparatus according to claim 2, wherein the said at least one touch sensitive area comprises a pad, switch or button which enables instructions or information to be entered.

4. Electronic apparatus according to claim 2, comprising written instructions on the bending wave panel member and associated with the at least one touch sensitive area.

5. Apparatus according to claim 1, wherein the said at least one touch sensitive area comprises a pad, switch or button which enables instructions or information to be entered.

6. Electronic apparatus according to claim 1, comprising written instructions on the bending wave panel member and associated with the at least one touch sensitive area.

7. A vending machine comprising a control panel and a delivery chute for dispensed product, wherein the control panel incorporates a bending wave panel loudspeaker having a user-accessible surface, an electro-acoustic vibration exciter on the panel to introduce bending wave energy into the panel in response to an electrical signal applied thereto, at least one touch sensitive area on the said user-accessible surface and responsive to user contact, and visible instructions on the panel and associated with the at least one touch sensitive area.

8. A vending machine according to claim 7, wherein the panel member has the capability to sustain and propagate input vibrational energy by a plurality of resonant bending wave modes in at least one operative area extending transversely of thickness, wherein the frequencies of resonant bending wave modes are interleaved in a predetermined frequency range so that resonant bending wave modes are substantially evenly distributed in frequency and wherein the vibration exciter is mounted on said operative area of the panel at a preferential location or site for coupling to the resonant bending wave modes, to vibrate the panel and excite said resonant bending wave modes in the panel, the resonant bending wave modes in turn producing an acoustic output.

* * * * *